US005153950A

United States Patent [19]

Sowers

[11] Patent Number: 5,153,950

[45] Date of Patent: Oct. 13, 1992

[54] DISPOSABLE BATHTUB LINER APPARATUS

[76] Inventor: Johnny M. Sowers, RR 12 Box 2211, Lexington, N.C. 27292

[21] Appl. No.: 740,716

[22] Filed: Aug. 6, 1991

[51] Int. Cl.[5] ..... A47K 3/02

[52] U.S. Cl. ..... 4/580; 4/655; 4/DIG. 18

[58] Field of Search ..... 4/507, 580, 581, 582, 4/583, 585, 593, 613, 655, 288, DIG. 18

[56] References Cited

U.S. PATENT DOCUMENTS

| | | | |
|---|---|---|---|
| 455,429 | 7/1891 | McDonald | 4/580 |
| 505,542 | 11/1895 | Smith | 4/580 |
| 2,419,801 | 4/1947 | Uphues | 4/593 |
| 3,300,790 | 1/1967 | Foote | 4/580 |
| 3,509,587 | 5/1970 | Fins | 4/288 |
| 3,614,793 | 10/1971 | Nemiroff | 4/580 |
| 3,931,651 | 1/1976 | Weir | 4/580 |
| 4,267,609 | 5/1981 | Altman et al. | 4/580 |
| 4,470,606 | 9/1984 | Knowles | 4/507 x |
| 4,970,734 | 11/1990 | Friedman et al. | 4/580 |
| 5,040,252 | 8/1991 | Taggart | 4/580 |

FOREIGN PATENT DOCUMENTS

| | | | |
|---|---|---|---|
| 2020978 | 11/1971 | Fed. Rep. of Germany | 4/580 |

*Primary Examiner*—Henry J. Recla
*Assistant Examiner*—Robert M. Fetsuga
*Attorney, Agent, or Firm*—Leon Gilden

[57] ABSTRACT

A flexible liner is arranged for positioning in a complementary manner within a bathtub cavity, wherein the liner includes a textured or roughened top surface to provide a frictional engagement surface for an individual directed within the bathtub. A modification of the invention includes a skeleton structure, including clamp members arranged for securement of the liner and further including a drain assembly arranged for permitting egress of water from the bathtub subsequent to use.

4 Claims, 4 Drawing Sheets

DISPOSABLE BATHTUB LINER APPARATUS

BACKGROUND OF THE INVENTION

1. Field of the Invention

The field of invention relates to bathtub apparatus, and more particularly pertains to a new and improved disposable bathtub liner apparatus wherein the same is arranged for positioning within an associated bathtub.

2. Description of the Prior Art

Liner apparatus is arranged for positioning within a bathtub structure to permit ease of maintenance of the bathtub in use. A removable bathtub liner is exemplified in the prior art in U.S. Pat. No. 3,931,651 to Weir wherein a thin flexible liner includes a horizontal flange, wherein the liner is removably mounted in contact with a top surface of an associated bathtub of magnetic or suction securing means.

U.S. Pat. No. 4,051,563 to Clarke sets forth a liner arranged for mounting within a bathtub, including a cushioned portion.

U.S. Pat. No. 4,069,523 to Ridgeway sets forth a bathtub, with a cushion liner formed of a foam-like material.

As such, it may be appreciated that there continues to be a need for a new and improved disposable bathtub liner apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of bathtub liner apparatus now present in the prior art, the present invention provides a disposable bathtub liner apparatus wherein the same utilizes a thin polymeric film arranged for securement within a bathtub cavity. As such, the general purpose of the present invention, which will be described subsequently in greater detail, is to provide a new and improved disposable bathtub liner apparatus which has all the advantages of the prior art bathtub liner apparatus and none of the disadvantages.

To attain this, the present invention provides a flexible liner arranged for positioning in a complementary manner within a bathtub cavity, wherein the liner includes a textured or roughened top surface to provide a frictional engagement surface for an individual directed within the bathtub. A modification of the invention includes a skeleton structure, including clamp members arranged for securement of the liner and further including a drain assembly arranged for permitting egress of water from the bathtub subsequent to use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved disposable bathtub liner apparatus which has all the advantages of the prior art bathtub liner apparatus and none of the disadvantages.

It is another object of the present invention to provide a new and improved disposable bathtub liner apparatus which may be easily and efficiently manufactured and marketed.

It is a further object of the present invention to provide a new and improved disposable bathtub liner apparatus which is of a durable and reliable construction.

An even further object of the present invention is to provide a new and improved disposable bathtub liner apparatus which is susceptible of a low cost of manufacture with regard to both materials and labor, and which accordingly is then susceptible of low prices of sale to the consuming public, thereby making such disposable bathtub apparatus economically available to the buying public.

Still yet another object of the present invention is to provide a new and improved disposable bathtub liner apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
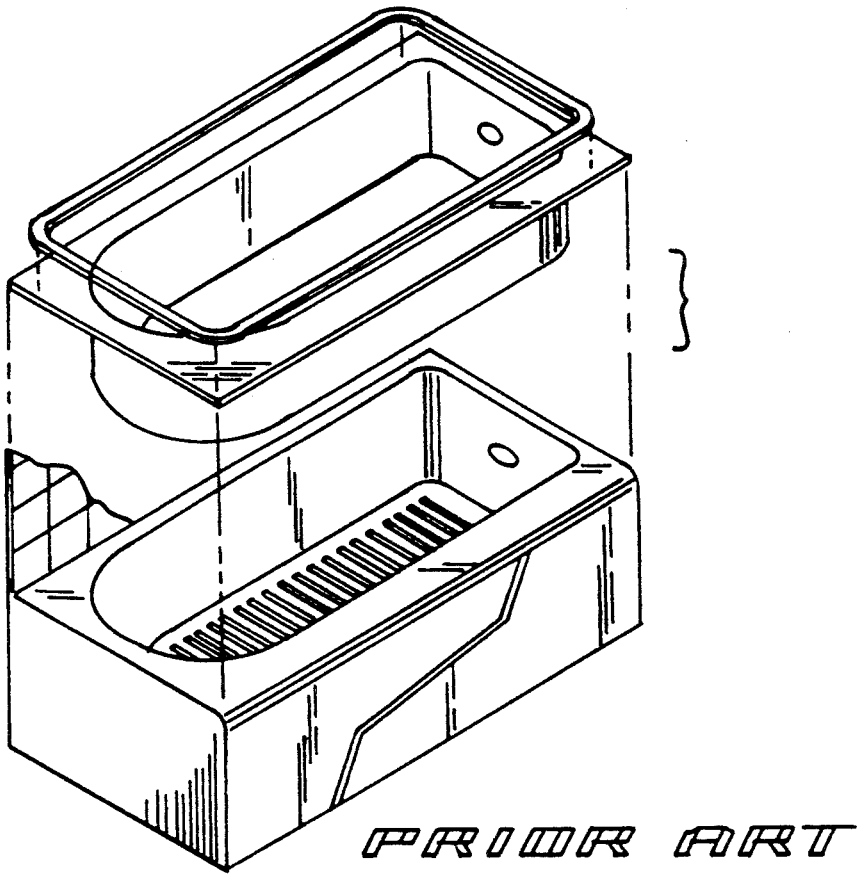
FIG. 1 is an isometric illustration of a prior art bathtub liner apparatus.

With reference now to the drawings, and in particular to FIGS. 1 to 6 thereof, a new and improved disposable bathtub liner apparatus embodying the principles and concepts of the present invention and generally designated by the reference numeral 10 will be described.

FIG. 1 illustrates a prior art bathtub liner apparatus, as set forth in U.S. Pat. No. 3,931,651, including a planar horizontal flange utilizing suction or magnetic means for mounting to the top surface of the associated bathtub.

Figure 2:
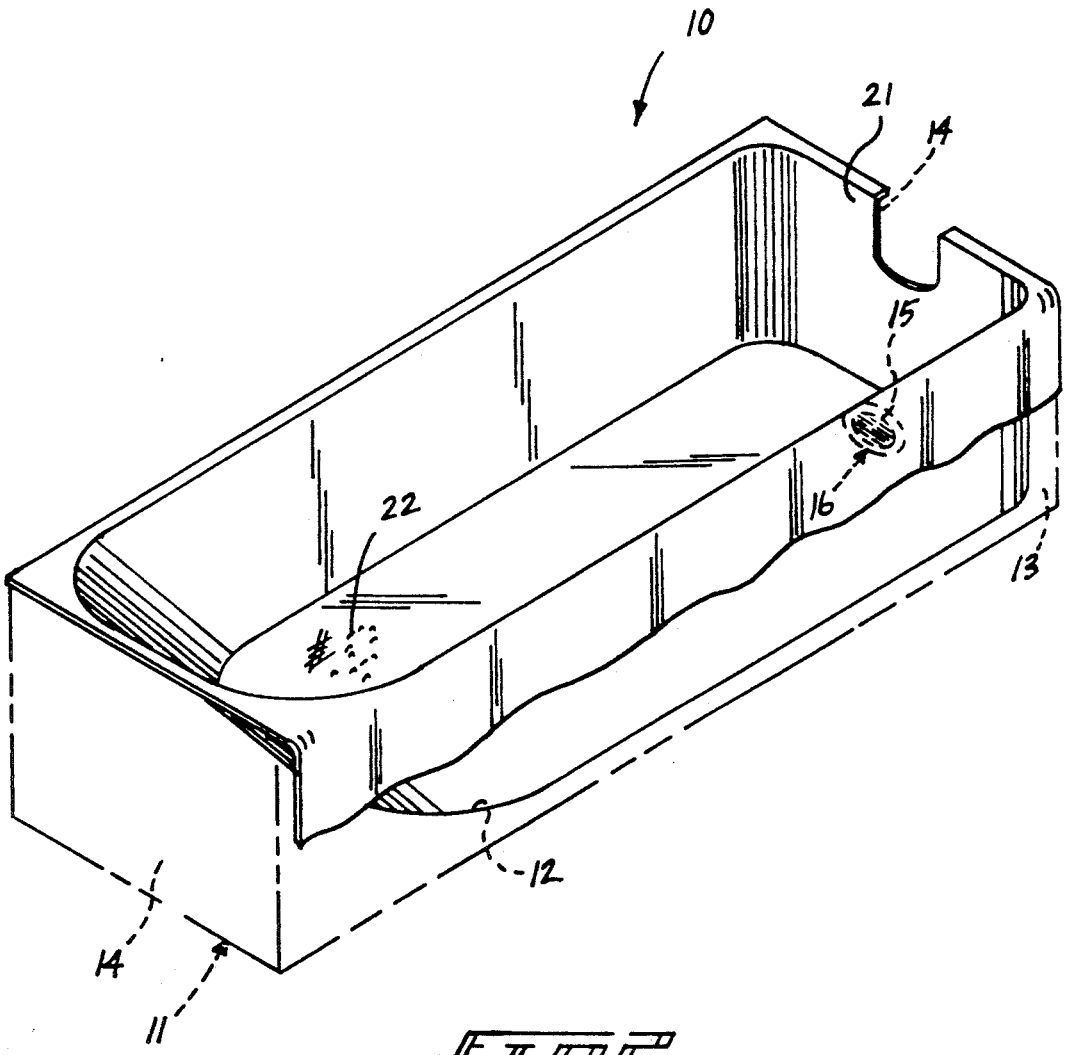
FIG. 2 is an isometric illustration of the instant invention.

More specifically, the disposable bathtub liner apparatus 10 of the instant invention essentially comprises the organization mounted within an associated bathtub member 11 that includes a bathtub floor 12, bathtub side walls 13, bathtub end walls 14, and a bathtub drain opening 15. The bathtub member accordingly defines a cavity for reception of a flexible liner apparatus 10 of the invention. The liner apparatus is arranged for draping over the top surface and side walls of the bathtub, as illustrated, to adhere through surface adhesion to the bathtub structure. To provide draining from the liner subsequent to its use, a drain assembly 16 is provided for mounting to the drain opening 15. The assembly 16 includes a annular mounting flange 17 adhesively mounted to the bathtub floor 12 in surrounding relationship relative to the drain opening 15. A cylindrical liner receiving ring 18 is fixedly and orthogonally mounted to the torroidal mounting flange 17 coaxially aligned therewith and extending upwardly thereof, wherein the receiving ring includes a plurality of ring projections 19 fixedly formed to an upper terminal end of the ring 18 spaced from the mounting flange 17. The flexible liner is thereafter positioned over the cylindrical receiving ring and associated flange 17, with a resilient "O" ring 20 then projecting over the projections 19 and thereafter positioned between the projections 19 and the flange 17 capturing the flexible liner to the receiving ring 18 in a sealing relationship. Subsequent to use, the flexible liner may be pierced to permit drainage through the opening 15. The flexible liner web 21 is arranged for formation with a textured top surface 22 formed with alternating ribs and projections, as illustrated in FIG. 2, to provide a frictional engaging surface for accommodating an individual in a non-slip relationship.

Figure 3:
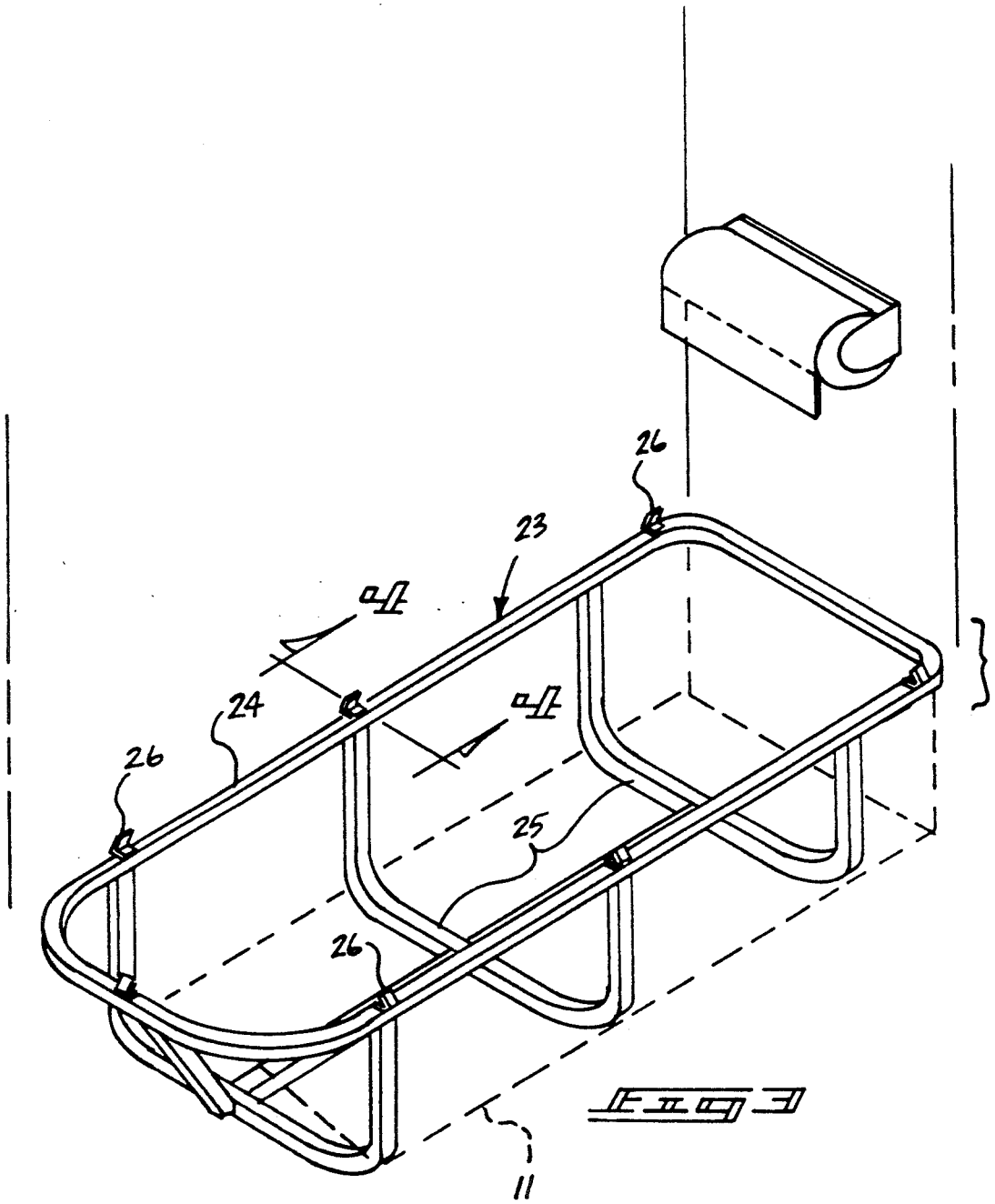
FIG. 3 is an isometric illustration of a skeleton structure utilized by the invention.
Figure 4A:
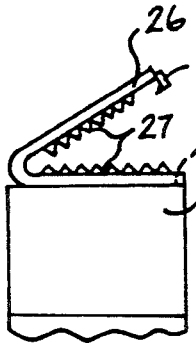
FIG. 4 is an orthographic view, taken along the lines 4—4 of FIG. 3 in the direction indicated by the arrows.
Figure 5:
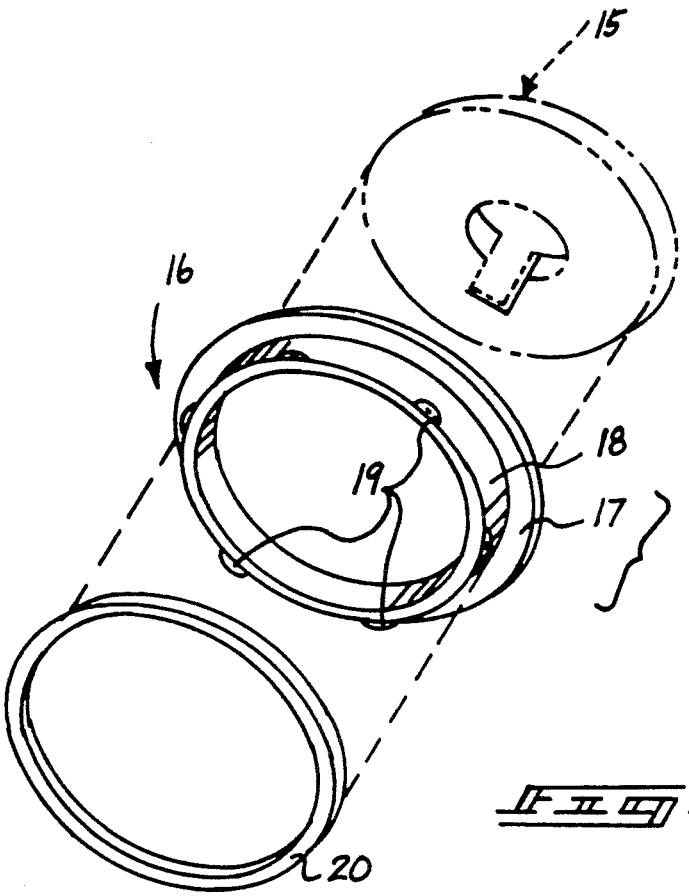
FIG. 5 is an isometric illustration of the drain assembly utilized by the invention.
Figure 6:
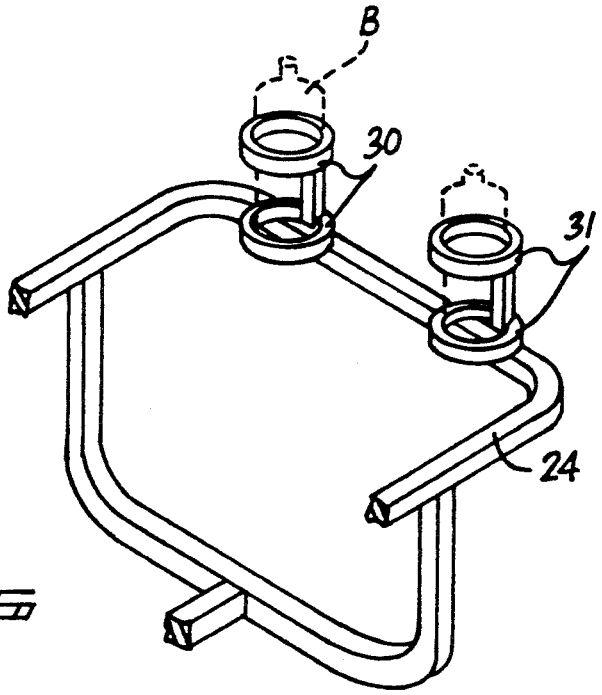
FIG. 6 is an isometric illustration of the skeleton framework, including mounting rings for positioning shampoo and soap containers therewithin.

Reference to FIGS. 3 and 6 illustrate the use of a skeleton framework 23 complementarily received within the bathtub member 11 cavity defining a continuous top frame 24 arranged parallel to the top surface of the bathtub, including "U" shaped support ribs 25 extending orthogonally and downwardly relative to the top frame 24. The top frame 24 includes a plurality of web clamps 26 mounted to a top surface of the top frame 24, wherein the web clamps are arranged for receiving the liner web 21 for enhancing and securement relative to the bathtub member 11. The web clamps include cooperating clamp teeth 27 mounted to respective upper and lower clamp webs, wherein a clamp latch 28 is mounted to the upper clamp web for reception within a receiving bore 29 to secure the upper clamp web relative to the lower clamp web.

FIG. 6 illustrates the use of a plurality of bottle receiving containers to mount a bottle "B" within a respective soap and shampoo mounting ring structure 30 and 31 respectively. The mounting ring structure includes a plurality of concentric mounting rings orthogonally mounted to the top surface of a top frame 24 for receiving a bottle "B" within each respective soap and shampoo mounting ring structure 30 and 31 respectively for ease of access to the shampoo and soap contents of each bottle.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A disposable bathtub liner apparatus arranged for securement within a bathtub member, wherein the bathtub member includes a bathtub floor, spaced bathtub side walls, and spaced bathtub end walls defining a bathtub cavity, with a drain opening directed through the bathtub floor, the apparatus comprising, a flexible liner web adapted to be complementarily positioned in contiguous communication within the bathtub cavity adhered to the bathtub floor, the bathtub side walls, the bathtub end walls, and overlying the drain opening, and the liner web including a textured top surface including ribs and projections to provide frictional engagement with an individual positioned within the cavity, and including an annular mounting flange adapted to be fixedly secured to the bathtub floor in surrounding coaxially aligned relationship relative to the drain opening, the annular mounting flange including a cylindrical liner receiving ring coaxially aligned within the mounting flange and extending upwardly thereof, the receiving ring including a plurality of ring projections fixedly mounted at spaced intervals to an upper terminal end of the receiving ring spaced from the mounting flange, and the liner web directed in surrounding relationship relative to the receiving ring, and a resilient "O" ring mounted about the receiving ring between the ring projections and the mounting flange to secure the liner about the ring.

2. An apparatus as set forth in claim 1 including a skeleton framework positioned within the bathtub cavity, the skeleton framework including a continuous top frame and including a plurality of "U" shaped support ribs extending orthogonally downwardly relative to the top frame, and the top frame including a plurality of web clamps mounted to a top surface of the top frame, each web clamp of the web clamps arranged for securing the liner web relative to the top frame.

3. An apparatus as set forth in claim 2, wherein each web clamp of the web clamps includes an upper clamp web and a lower clamp web, the lower clamp web of each of the web clamps fixedly mounted to the top surface of the top frame, and the upper web and the lower web each including cooperating clamping teeth to enhance engagement of each said web clamp to the liner web, and the upper web including a clamp latch, and the lower web including a receiving bore, wherein the clamp latch is directed through the receiving bore to secure the upper web relative to the lower web.

4. An apparatus as set forth in claim 3, wherein the top frame includes a soap mounting ring structure fixedly mounted to the top frame, and a shampoo mounting ring structure fixedly mounted to the top surface of the top surface of the top frame, each mounting ring structure including a plurality of concentric spaced rings fixedly mounted to the top surface of the top frame for receiving a bottle "B" within each of said soap mounting ring structure and shampoo mounting ring structure.

* * * * *